US008344605B2

(12) United States Patent
Suzuki et al.

(10) Patent No.: US 8,344,605 B2
(45) Date of Patent: Jan. 1, 2013

(54) SPARK PLUG AND MANUFACTURING METHOD THEREFOR

(75) Inventors: Takahiro Suzuki, Nagoya (JP); Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 59 days.

(21) Appl. No.: 13/127,196

(22) PCT Filed: Nov. 5, 2009

(86) PCT No.: PCT/JP2009/068894

§ 371 (c)(1), (2), (4) Date: May 2, 2011

(87) PCT Pub. No.: WO2010/053116

PCT Pub. Date: May 14, 2010

(65) Prior Publication Data

US 2011/0210659 A1 Sep. 1, 2011

(30) Foreign Application Priority Data

Nov. 6, 2008 (JP) ..... 2008-284932

(51) Int. Cl.
*H01T 13/20* (2006.01)
*H01T 21/00* (2006.01)

(52) U.S. Cl. ..... 313/141; 445/7

(58) Field of Classification Search ..... 313/141; 123/169 EL; 445/7
See application file for complete search history.

(56) References Cited

U.S. PATENT DOCUMENTS

| | | | | |
|---|---|---|---|---|
| 4,331,899 | A * | 5/1982 | Nishida et al. | 313/141 |
| 6,304,022 | B1 | 10/2001 | Matsutani | |
| 2006/0220511 | A1 | 10/2006 | Hanashi et al. | |
| 2007/0188065 | A1 | 8/2007 | Ishinada et al. | |
| 2010/0109502 | A1 * | 5/2010 | Nakayama et al. | 313/141 |
| 2010/0253203 | A1 * | 10/2010 | Suzuki et al. | 313/141 |

FOREIGN PATENT DOCUMENTS

| | | | |
|---|---|---|---|
| DE | 3820552 | A1 | 12/1989 |
| JP | 60-129089 | U | 8/1985 |
| JP | 5-275157 | A | 10/1993 |
| JP | 11-204233 | A | 7/1999 |
| JP | 2006-286469 | A | 10/2006 |
| JP | 2007-242588 | A | 9/2007 |
| WO | 2008/123344 | A1 | 10/2008 |

* cited by examiner

*Primary Examiner* — Karabi Guharay
(74) *Attorney, Agent, or Firm* — Sughrue Mion, PLLC

(57) ABSTRACT

Provided are a spark plug in which the occurrence of spark blowout or the like is restrained for improvement of ignition performance, and a method of manufacturing the spark plug. A ground electrode (27 ) of the spark plug has a protrusion (28 ) which faces a center electrode (5). The distal end surface of the protrusion (28) has a noble metal tip (32) provided at the center thereof and includes an annular fusion portion (33) adjacent to the periphery of the noble metal tip (32), and an annular electrode base metal surface located externally of the annular fusion portion (33). A spark discharge gap (35) is formed between the center electrode (5) and the distal end of the protrusion (28) including the noble metal tip (32).

7 Claims, 6 Drawing Sheets

SPARK PLUG AND MANUFACTURING METHOD THEREFOR

TECHNICAL FIELD

The present invention relates to a spark plug for use in an internal combustion engine, such as an automotive engine, and to a manufacturing method therefor.

BACKGROUND ART

Generally, a spark plug for use in an internal combustion engine, such as an automotive engine, is configured to ignite an air-fuel mixture supplied into a combustion chamber of the internal combustion engine through generation of spark discharges across a spark discharge gap between a center electrode and a ground electrode.

In recent years, in order to cope with exhaust gas regulations and to improve fuel economy, lean-burn engines, direct-injection engines, low-emission engines, and like internal combustion engines have been actively developed. For ignition of an air-fuel mixture, these internal combustion engines require a spark plug higher in ignition performance than conventional spark plugs.

A known spark plug having enhanced ignition performance has a ground electrode on which a protrusion is formed.

Examples of such a spark plug include a spark plug in which a noble metal tip of an iridium alloy, a platinum alloy, or the like, which exhibits excellent resistance to spark-induced erosion and to oxidation-induced erosion, is welded to an electrode base metal, such as a nickel alloy, of a ground electrode, thereby forming a protrusion, and a spark plug in which, in place of welding of a noble metal tip, the electrode base metal of the ground electrode is machined to form a protrusion (refer to, for example, Patent Document 1).

PRIOR ART DOCUMENT

Patent Document

Patent Document 1: Japanese Patent Application Laid-Open (kokai) No. 2006-286469

SUMMARY OF THE INVENTION

Problems to be Solved by the Invention

However, more and more internal combustion engines are of a high-swirl type in which the velocity of an air-fuel mixture within a combustion chamber is increased in order to improve ignition performance. Such internal combustion engines involve a high risk of the occurrence of so-called spark blowout or a like problem, in which sparks generated across a spark discharge gap are blown out with resultant misfire.

The present invention has been conceived in view of the above circumstances, and an object of the invention is to provide a spark plug in which the occurrence of spark blowout or the like is restrained for improvement of ignition performance, and a method of manufacturing the spark plug.

Means for Solving the Problems

Configurations suitable for solving the above problems will next be described in itemized form. If needed, actions and effects peculiar to the configurations will be described additionally.

Configuration 1: A spark plug of the present invention comprises a center electrode extending in a direction of an axis, an insulator which holds the center electrode, a metallic shell which holds the insulator, a ground electrode whose proximal end portion is joined to a front end portion of the metallic shell and which is bent and fixed such that an inside surface of a distal end portion thereof faces a front end portion of the center electrode, and a noble metal tip joined to the inside surface of the ground electrode, a spark discharge gap being formed between the center electrode and the noble metal tip of the ground electrode. The spark plug is characterized in the following: the inside surface of the ground electrode has a columnar protrusion projecting in the direction of the axis and formed of an electrode base metal of the ground electrode which contains nickel as a main component; the noble metal tip whose cross-sectional area is smaller than an area of a distal end surface of the protrusion is joined to the distal end surface of the protrusion, and a discharge allowance surface is a part of the distal end surface of the protrusion and is formed around at least a portion of a periphery of the noble metal tip, the discharge allowance surface is formed of the electrode base metal of the ground electrode; a distance between a discharge surface of the center electrode and a discharge surface of the noble metal tip of the ground electrode as measured along the direction of the axis; i.e., a dimension of the spark discharge gap, is 0.8 mm or greater; a distance between the inside surface of the ground electrode and the discharge surface of the noble metal tip of the ground electrode as measured along the direction of the axis; i.e., a projecting dimension of the noble metal tip of the ground electrode, is 0.5 mm or greater; and when the discharge surface of the center electrode and the discharge surface of the noble metal tip of the ground electrode are projected onto a plane orthogonal to the direction of the axis, a projected image of the discharge surface of the center electrode does not protrude from a projected image of the discharge surface of the noble metal tip of the ground electrode.

According to configuration 1 mentioned above, the noble metal tip, which primarily constitutes the discharge surface, is joined to the distal end surface of the protrusion formed on the ground electrode, and the discharge allowance surface formed of the electrode base metal which contains nickel as a main component is formed around the noble metal tip.

By virtue of this configuration, in an ordinary situation, discharge is generated between the center electrode and the noble metal tip of the ground electrode, whereas, when sparks drift by the influence of swirls or the like, the discharge allowance surface (nickel base metal portion) around the noble metal tip functions as a discharge surface, whereby discharge is maintained.

A nickel alloy which serves as the electrode base metal is apt to be oxidized as compared with a noble metal, such as iridium or platinum, used to form the noble metal tip. Thus, in the course of use of the spark plug, as a result of exposure to a high-temperature atmosphere in a combustion chamber, an oxide film is formed on the surface of the electrode base metal. Generally, a metal oxide is small in work function as compared with a noble metal, such as iridium or platinum. Therefore, conceivably, when discharge is generated at a portion of the electrode base metal on which an oxide film is formed, discharge is likely to be maintained.

As a result, while deterioration in electrode durability is restrained through use of the noble metal tip, the occurrence of spark blowout or the like is restrained, whereby ignition performance can be improved.

However, in the case of a configuration in which, when the discharge surface of the center electrode and the discharge surface of the noble metal tip of the ground electrode are projected onto a plane orthogonal to the direction of the axis, a projected image of the discharge surface of the center electrode protrudes from a projected image of the discharge surface of the noble metal tip of the ground electrode, sparks are apt to be directed to the discharge allowance surface (nickel base metal portion), potentially resulting in deterioration in durability. That is, the provision of the noble metal tip for enhancement of durability becomes less meaningful.

By contrast, through employment of the present configuration 1, in which a projected image of the discharge surface of the center electrode does not protrude from a projected image of the discharge surface of the noble metal tip of the ground electrode, in a condition free from the influence of swirls or the like, discharge is generated between the center electrode and the noble metal tip of the ground electrode, and, when sparks drift by the influence of swirls or the like, discharge is maintained between the center electrode and the discharge allowance surface. As a result, sparking to the discharge allowance surface is restrained, whereby deterioration in durability can be restrained.

In a spark plug having a spark discharge gap of less than 0.8 mm or a projecting dimension of the noble metal tip of the ground electrode of less than 0.5 mm, spark blowout or a like problem is inherently unlikely to occur. Therefore, actions and effects of the present configuration 1 are further yielded in application of the present invention to a spark plug having a spark discharge gap of 0.8 mm or greater and a projecting dimension of the noble metal tip of 0.5 mm or greater.

Herein, the term "main component" refers to a component whose mass ratio is the highest among components of the material concerned (the same also applies to the following description).

In the case where the noble metal tip is laser-welded to the protrusion, a fusion portion is formed around the noble metal tip. Since the fusion portion is formed through fusion between the noble metal tip and the electrode base metal of the ground electrode, the fusion portion is excluded from the "discharge allowance surface formed of the electrode base metal of the ground electrode."

In the case where the noble metal tip is resistance-welded to the protrusion, a welding droop is formed around the noble metal tip in such a manner that, in the course of welding, the noble metal tip pushes away the surface of the electrode base metal. Since the welding droop has the same composition as that of the electrode base metal, the welding droop may be included in the "discharge allowance surface formed of the electrode base metal of the ground electrode."

Configuration 2: A spark plug of the present configuration is characterized in that, in configuration 1 mentioned above, the discharge allowance surface has a chamfer portion at an edge thereof.

Examples of the chamfer portion include a rounded chamfer portion having a curved shape and a flat chamfer portion having a taper shape.

According to configuration 2, chamfering is performed on an edge of the discharge allowance surface; i.e., on a corner portion between the distal end surface and the side surface of the protrusion. The formation of the chamfer portion can restrain the occurrence of spark blowout at the corner portion. As a result, actions and effects of configuration 1 mentioned above can be further enhanced.

Configuration 3: A spark plug of the present configuration is characterized in that, in configuration 1 or 2 mentioned above, the discharge allowance surface is formed around the entire periphery of the noble metal tip.

According to configuration 3 mentioned above, since the discharge allowance surface is formed around the entire periphery of the noble metal tip, even when sparks drift in any direction by the influence of swirls or the like, discharge is reliably maintained.

Configuration 4: A spark plug of the present configuration is characterized in that, in any one of configurations 1 to 3 mentioned above, the protrusion and the noble metal tip are in such a relation that a minimum distance between an outer periphery of the protrusion and an outer periphery of the noble metal tip is 0.1 mm to 0.5 mm inclusive.

Even though the cross-sectional area of the noble metal tip is set smaller than the area of the distal end surface of the protrusion, if the area of the discharge allowance surface is small such that the minimum distance between the outer periphery of the protrusion and the outer periphery of the noble metal tip is less than 0.1 mm, actions and effects of configuration 1 mentioned above may be unlikely to be yielded. Also, if the area of the discharge allowance surface is large such that the minimum distance therebetween is in excess of 0.5 mm, ignition performance and workability may deteriorate. Employing configuration 4 mentioned above in view of this prevents the occurrence of such a problem and reliably yields the actions and effects of configuration 1.

Configuration 5: A spark plug of the present configuration is characterized in that, in any one of configurations 1 to 4 mentioned above, the noble metal tip projects from the distal end surface of the protrusion such that a projecting dimension of the noble metal tip as measured from the distal end surface of the protrusion along the direction of the axis is 0 mm to 0.2 mm inclusive.

When the projecting dimension of the noble metal tip is less than 0 mm; i.e., when the noble metal tip is recessed from the distal end surface of the protrusion, the distance between the center electrode and the discharge allowance surface around the noble metal tip becomes smaller than that between the center distance and the noble metal tip. Accordingly, sparks are apt to be directed to the discharge allowance surface, potentially resulting in deterioration in durability. That is, the provision of the noble metal tip for enhancement of durability becomes less meaningful. Also, when the projecting dimension becomes large in excess of 0.2 mm, similar to a conventional spark plug, the risk of occurrence of spark blowout increases. In view of this, in order to generate discharge between the center electrode and the noble metal tip in an ordinary situation and to maintain discharge between the center electrode and the discharge allowance surface when sparks drift by the influence of swirls or the like, the employment of configuration 5 mentioned above is preferred. As a result, actions and effects of configuration 1 mentioned above are more reliably yielded.

Configuration 6: A spark plug of the present configuration is characterized in that, in any one of configurations 1 to 5 mentioned above, the ground electrode has a hole portion formed at an outside surface opposite the inside surface of the ground electrode with respect to the direction of the axis at a position corresponding to the protrusion.

Configuration 7: A method of manufacturing a spark plug of the present configuration manufactures a spark plug comprising a center electrode extending in a direction of an axis, an insulator which holds the center electrode, a metallic shell which holds the insulator, a ground electrode whose proximal end portion is joined to a front end portion of the metallic shell and which is bent and fixed such that an inside surface of a distal end portion thereof faces a front end portion of the center electrode, a columnar protrusion provided at the inside surface of the ground electrode, and a noble metal tip joined to a distal end surface of the protrusion, a spark discharge gap being formed between the center electrode and the noble metal tip of the ground electrode and between the center electrode and the distal end surface of the protrusion. The manufacturing method comprises a welding step of welding the noble metal tip to an original body of the ground electrode having substantially the form of a straight bar; a press working step of performing press working on the original body of the ground electrode at least in a region which encompasses the noble metal tip, from a side opposite a side from which the noble metal tip is welded, thereby forming the protrusion; and a bending step of bending the original body of the ground electrode in such a manner that the distal end surface of the protrusion including the noble metal tip faces the front end portion of the center electrode, thereby forming the spark discharge gap.

According to configuration 7 mentioned above, before formation of the protrusion, the noble metal tip is welded, whereby the welding step becomes relatively easy. Further, employing a press working process for formation of the protrusion facilitates impartment of a required projecting amount to the protrusion.

MODES FOR CARRYING OUT THE INVENTION

Figure 1:
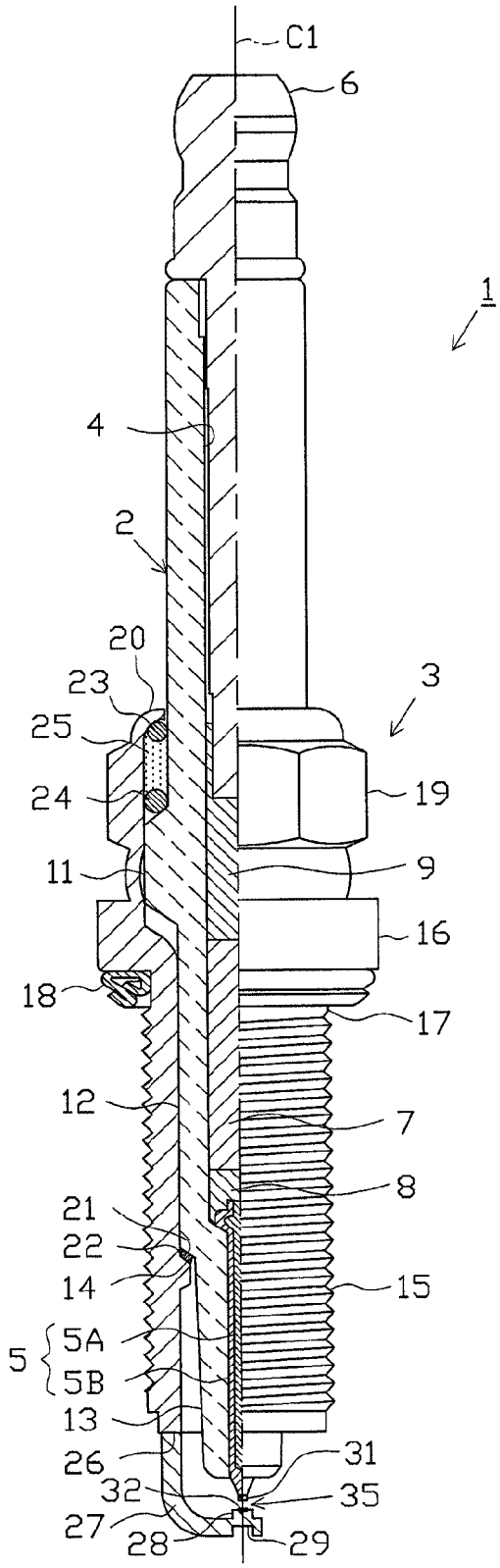
[FIG. 1] Partially cutaway front view showing a spark plug according to an embodiment of the present invention.

An embodiment of the present invention will next be described with reference to the drawings. FIG. 1 is a partially cutaway front view showing a spark plug 1. In FIG. 1, the direction of an axis C1 of the spark plug 1 is referred to as the vertical direction. In the following description, the lower side of the spark plug 1 in FIG. 1 is referred to as the front side of the spark plug 1, and the upper side as the rear side.

The spark plug 1 includes an elongated ceramic insulator 2, which serves as the insulator of the present invention, and a tubular metallic shell 3, which holds the ceramic insulator 2 therein.

The ceramic insulator 2 has an axial hole 4 extending therethrough along the axis C1. A center electrode 5 is fixedly inserted into a front end portion of the axial hole 4. A terminal electrode 6 is fixedly inserted into a rear end portion of the axial hole 4. A resistor 7 is disposed within the axial hole 4 between the center electrode 5 and the terminal electrode 6. Opposite end portions of the resistor 7 are electrically connected to the center electrode 5 and the terminal electrode 6 via conductive glass seal layers 8 and 9, respectively.

The center electrode 5 is fixed while projecting from the front end of the ceramic insulator 2, and the terminal electrode 6 is fixed while projecting from the rear end of the ceramic insulator 2.

The insulator 2 is formed from alumina or the like by firing, as well known in the art. The insulator 2, as viewed externally, includes a flange-like large-diameter portion 11, which projects radially outward substantially at a central portion of the insulator 2 with respect to the direction of the axis C1; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. A frontward portion of the ceramic insulator 2 which includes the large-diameter portion 11, the intermediate trunk portion 12, and the leg portion 13 is accommodated in the tubular metallic shell 3. A stepped portion 14 is formed at a connection portion between the leg portion 13 and the intermediate trunk portion 12. The ceramic insulator 2 is seated on the metallic shell 3 at the stepped portion 14.

The metallic shell 3 is formed into a tubular shape from a low-carbon steel or a like metal. The metallic shell 3 has a threaded portion (externally threaded portion) 15 on its outer circumferential surface. The threaded portion 15 is adapted to mount the spark plug 1 to an engine head. The metallic shell 3 has a seat portion 16 formed on its outer circumferential surface and located rearward of the threaded portion 15. A ring-like gasket 18 is fitted to a screw neck 17 located at the rear end of the threaded portion 15. Also, the metallic shell 3 has a tool engagement portion 19 provided near its rear end. The tool engagement portion 19 has a hexagonal cross section and allows a tool such as a wrench to be engaged therewith when the metallic shell 3 is to be attached to the engine head. Further, the metallic shell 3 has a crimp portion 20 provided at its rear end portion and adapted to hold the ceramic insulator 2.

Also, the metallic shell 3 has a stepped portion 21 provided on its inner circumferential surface and adapted to allow the ceramic insulator 2 to be seated thereon. The ceramic insulator 2 is inserted frontward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed in place. An annular sheet packing 22 intervenes between the stepped portions 14 and 21 of the ceramic insulator 2 and the metallic shell 3, respectively. This retains gastightness of a combustion chamber and prevents leakage of an air-fuel mixture to the exterior of the spark plug 1 through a clearance between the inner circumferential surface of the metallic shell 3 and the leg portion 13 of the ceramic insulator 2, which leg portion 13 is exposed to the combustion chamber.

Further, in order to ensure gastightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

A substantially L-shaped ground electrode 27 is joined to a front end surface 26 of the metallic shell 3. That is, a proximal end portion of the ground electrode 27 is welded to the front end surface 26 of the metallic shell 3, and a distal end portion of the ground electrode 27 is bent such that the inside surface of the distal end portion faces a front end portion of the center electrode 5.

Figure 2:
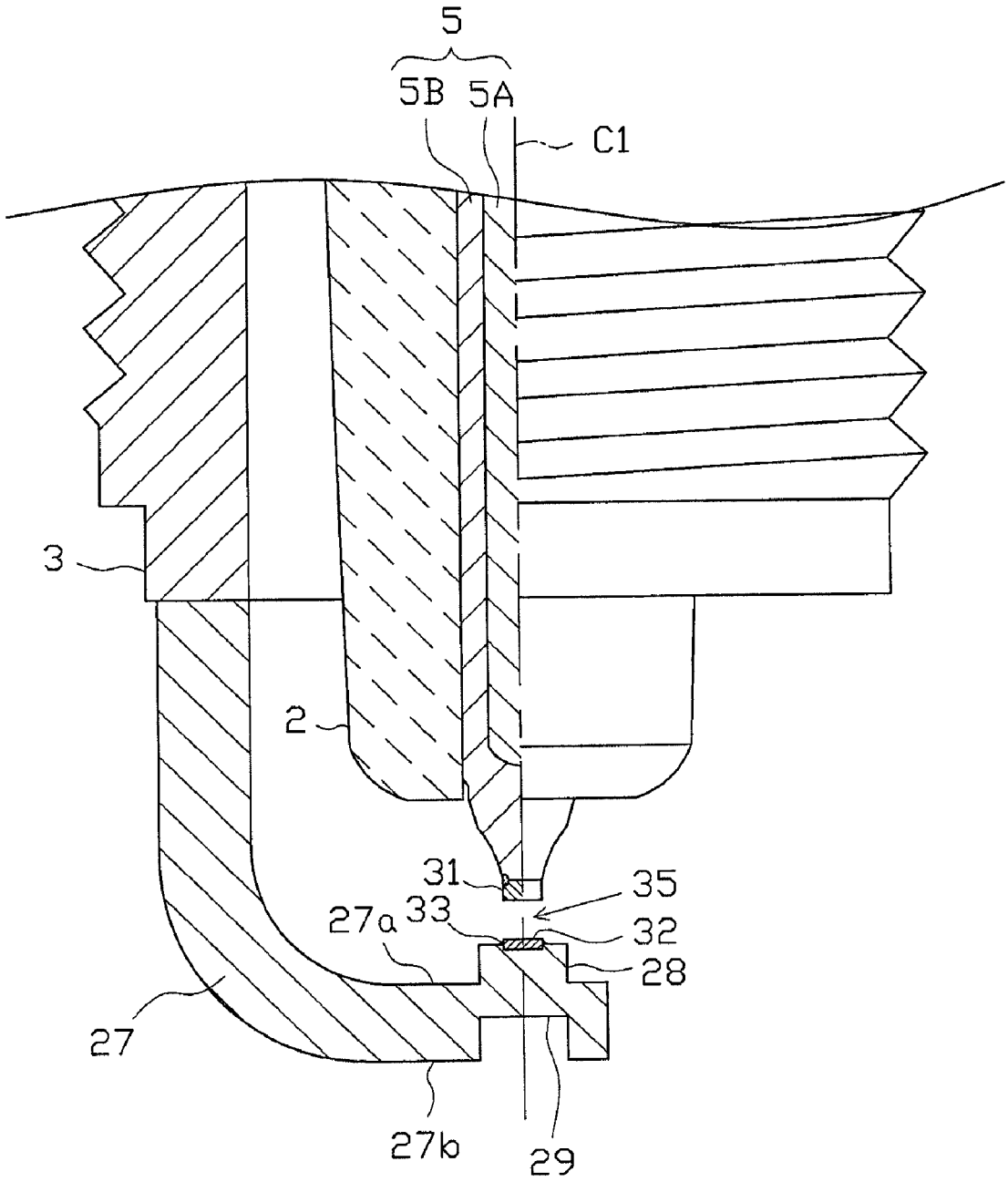
[FIG. 2] Enlarged partially cutaway view showing essential portions (an essential portion of a center electrode and that of a ground electrode) at a front end portion of the spark plug.

The configurations of the center electrode 5 and the ground electrode 27 will next be described in detail with reference to FIG. 2. FIG. 2 is an enlarged partially cutaway view showing essential portions (an essential portion of the center electrode 5 and that of the ground electrode 27) at a front end portion of the spark plug 1.

A nickel (Ni) alloy which contains nickel as a main component is used as electrode base metals of the center electrode 5 and the ground electrode 27. A thermally conductive core made of copper or a copper alloy is embedded in the center electrode 5 for enhancing thermal conductivity. Thus, the center electrode 5 is composed of an inner layer 5A made of copper or a copper alloy, and an outer layer 5B made of an Ni alloy.

The center electrode 5 has a rodlike shape as a whole, and a front end portion of the center electrode 5 is reduced in diameter. A circular columnar noble metal tip 31 is joined to the front end of the center electrode 5 by resistance welding, laser welding, or the like.

The ground electrode 27 has a protrusion 28 formed at an inside surface 27*a*, which faces the center electrode 5, and the protrusion 28 faces the noble metal tip 31. The protrusion 28 projects from the inside surface 27*a* of the ground electrode 27 toward the center electrode 5 along the direction of the axis C1. The protrusion 28 has a circular columnar shape having substantially a circular cross section taken along a radial direction (left-right direction in FIG. 2) orthogonal to the direction of the axis C1. As will be described later, the protrusion 28 is formed through press working from an outside surface 27*b* of the ground electrode 27. Thus, the outside surface 27*b* of the ground electrode 27 has a bottomed hole portion 29 formed in association with press working.

A circular columnar noble metal tip 32 is laser-welded to the distal end surface of the protrusion 28. The noble metal tip 32 is formed of a noble metal alloy which contains a noble metal, such as iridium or platinum, as a main component.

Figure 3:
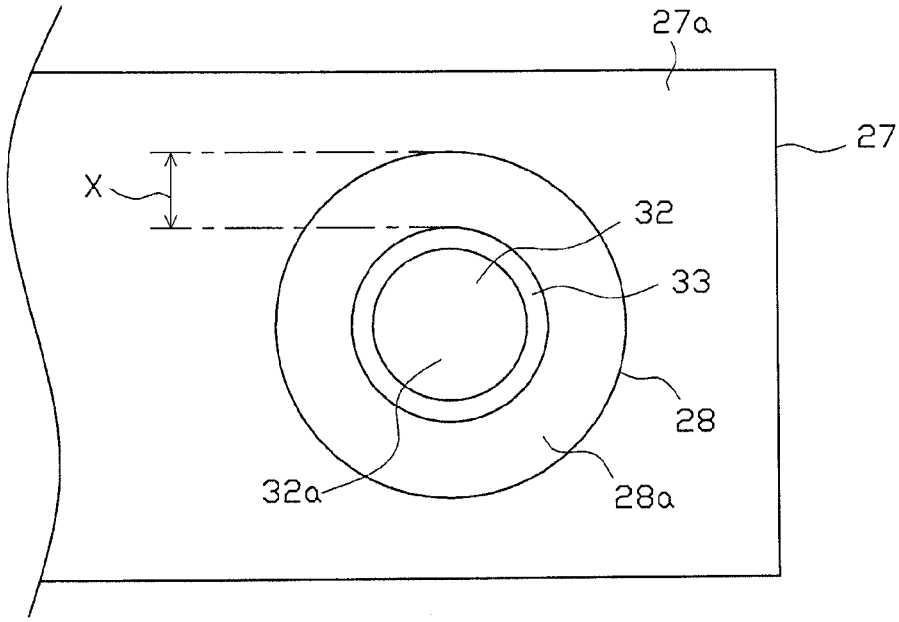
[FIG. 3] Schematic view of a protrusion of the ground electrode as viewed from the center electrode in the direction of an axis.
Figure 4:
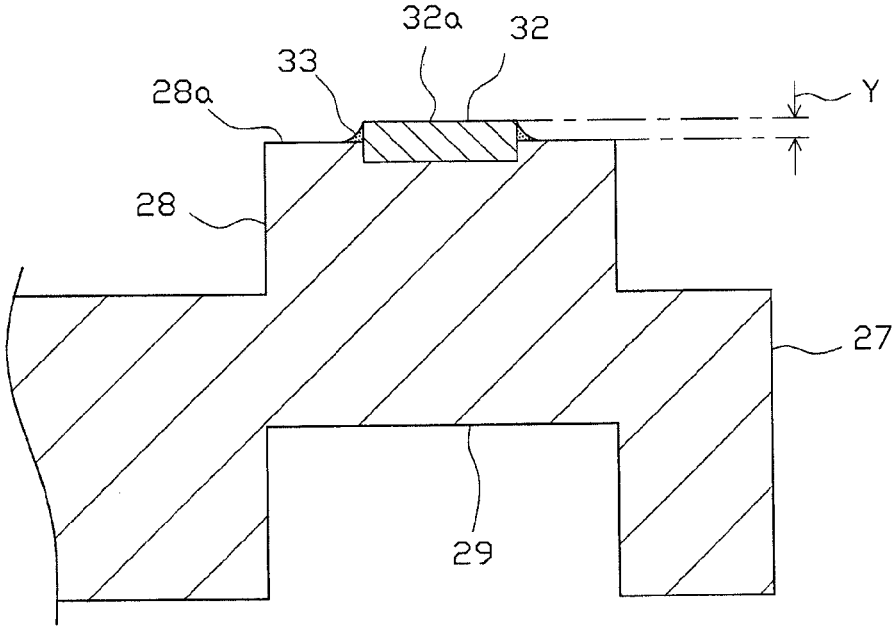
[FIG. 4] Schematic sectional view showing the protrusion and its vicinity of the ground electrode.

As shown in FIGS. 3 and 4, the cross-sectional area of the noble metal tip 32 is smaller than the area of the distal end surface of the protrusion 28. The distal end surface of the protrusion 28 has the noble metal tip 32 provided at the center thereof and is configured to have an annular fusion portion 33 adjacent to the periphery of the noble metal tip 32, and an annular electrode base metal surface 28*a* located externally of the annular fusion portion 33. The electrode base metal surface 28*a* serves as a discharge allowance surface in the present embodiment. In the present embodiment, the electrode base metal surface 28*a* is formed around the entire periphery of the noble metal tip 32 and has a width (a minimum distance between the outer periphery of the protrusion 28 and the outer periphery of an area which encompasses the noble metal tip 32 and the fusion portion 33) X of 0.1 mm to 0.5 mm inclusive as measured along a radial direction of the protrusion 28.

Also, as shown in FIG. 4, the noble metal tip 32 is joined to the protrusion 28 in such a manner as to be flush with or project from the electrode base metal surface 28*a* of the protrusion 28. In the present embodiment, the distance between the electrode base metal surface 28*a* of the protrusion 28 and a discharge surface (a surface which faces the noble metal tip 31 of the center electrode 5) 32*a* of the noble metal tip 32 as measured along the direction of the axis C1; i.e., a projecting dimension Y of the noble metal tip 32, is 0 mm to 0.2 mm inclusive.

While the above configuration is employed, a spark discharge gap 35 is formed between the center electrode 5 and the protrusion 28. In an ordinary situation, discharge is generated between the noble metal tips 31 and 32, whereas, when sparks drift by the influence of swirls or the like, the electrode base metal surface 28*a* of the noble metal tip 32 functions as a discharge surface, whereby discharge is maintained.

As a result, according to the thus-configured spark plug 1, while deterioration in durability of the ground electrode 27 is restrained, the occurrence of spark blowout or the like can be restrained, and ignition performance can be improved.

Next, a method of manufacturing the thus-configured spark plug 1 is described. First, the metallic shell 3 is formed beforehand. Specifically, a circular columnar metal material (e.g., an iron-based material, such as S17C or S25C, or a stainless steel material) is subjected to cold forging for forming a through hole and a general shape. Subsequently, machining is conducted so as to adjust the outline, thereby yielding a metallic-shell intermediate.

Then, an original body of the ground electrode 27 is fabricated. Specifically, first, an Ni alloy is subjected to casting and annealing to fabricate the original body of the ground electrode 27. For example, by use of a vacuum melting furnace, a molten Ni alloy is prepared. An ingot is prepared from the molten Ni alloy by means of vacuum casting or the like. The ingot is subjected to hot working, drawing, etc., thereby yielding the original body of the ground electrode 27 having predetermined dimensions and shape.

Then, the thus-formed original body of the ground electrode 27 is resistance-welded to the front end surface of the metallic-shell intermediate. Subsequently, the threaded portion 15 is formed in a predetermined region of the metallic-shell intermediate by rolling. Thus, the metallic shell 3 to which the original body of the ground electrode 27 is welded is obtained. The metallic shell 3 to which the original body of the ground electrode 27 is welded is subjected to galvanization or nickel plating.

Separately from preparation of the metallic shell 3, the ceramic insulator 2 is formed. For example, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to grinding for shaping. The shaped green compact is placed in a kiln, followed by firing. The resultant fired body is subjected to various kinds of polishing, thereby yielding the ceramic insulator 2.

Also, separately from preparation of the metallic shell 3 and the ceramic insulator 2, the center electrode 5 is formed. Specifically, the outer layer 5B is formed from an Ni alloy by forging. The inner layer 5A made of copper or a copper alloy is disposed in a central portion of the outer layer 5B. Further, the noble metal tip 31 is joined to a front end portion of the outer layer 5B by resistance welding, laser welding, or the like.

Then, the ceramic insulator 2 and the center electrode 5, which are formed as mentioned above, the resistor 7, and the terminal electrode 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the ceramic insulator 2 such that the resistor 7 is sandwiched between the charged portions of the mixture. Subsequently, the resultant assembly is heated in a kiln in a condition in which the charged mixture is pressed from the rear by the terminal electrode 6, thereby being fired and hardened.

Subsequently, the thus-formed ceramic insulator 2 having the center electrode 5, the terminal electrode 6, etc., and the metallic shell 3 having original body of the ground electrode 27 are assembled together. More specifically, a relatively thin-walled rear-end opening portion of the metallic shell 3 is crimped radially inward; i.e., the above-mentioned crimp portion 20 is formed, thereby fixing the ceramic insulator 2 and the metallic shell 3 together.

Then, the noble metal tip 32 is laser-welded to a predetermined region of the original body of the ground electrode 27 joined to the metallic shell 3 to which the ceramic insulator 2 is assembled. This step corresponds to a welding step in the present embodiment.

The laser welding of the noble metal tip 32 is performed, for example, as follows. The noble metal tip 32 is resistance-welded beforehand to the predetermined region of the original body of the ground electrode 27. A laser beam is radiated along the periphery of the resistance-welded noble metal tip 32, thereby laser-welding the noble metal tip 32 and the original body of the ground electrode 27 together. This laser welding is accompanied by formation, around the noble metal tip 32, of the fusion portion 33, where an Ni alloy serving as the electrode base metal of the ground electrode 27 and a noble metal alloy serving as a component of the noble metal tip 32 are fused together.

Press working is performed on the original body of the ground electrode 27 at a position opposite the welded position of the noble metal tip 32, thereby forming the protrusion 28 and the hole portion 29. This step corresponds to a press working step in the present embodiment.

For fabrication of the original body of the ground electrode 27, a known press working machine having a punch capable of forming the hole portion can be employed.

An example press working machine includes a punch; a plate-like press die having a through hole through which the punch moves; a support die having a groove-like accommodation portion for accommodating the original body of the ground electrode 27 therein and a through hole formed in the accommodation portion, the press die being disposed on the upper surface of the support die; and a support pin inserted into the through hole of the support die.

By use of the press working machine, press working is performed on the original body of the ground electrode 27 as follows. The press die is fixedly disposed on the upper surface of the support die which accommodates the original body of the ground electrode 27 in its accommodation portion. The punch is caused to extrude from the through hole of the press die and to press the original body of the ground electrode 27. By this procedure, an associated portion of the original body of the ground electrode 27 is extruded into the through hole of the support die while being supported by the support pin, whereby the protrusion 28 of the ground electrode 27 is formed. At this time, through adjustment of the shape and dimensions of the punch, the shape and dimensions of the hole portion 29 can be adjusted. Also, through adjustment of the shape and dimensions of the through hole of the support die and/or the shape and dimensions of the support pin, the shape and dimensions of the protrusion 28 can be adjusted.

Finally, the original body of the ground electrode 27 is bent into the ground electrode 27 having a final shape, thereby forming the spark discharge gap 35. This step corresponds to a bending step in the present embodiment. At this time, the gap between the noble metal tip 31 located at the front end of the center electrode 5 and the distal end surface of the protrusion 28 including the noble metal tip 32 of the ground electrode 27 is adjusted.

Through a series of the steps mentioned above, the spark plug 1 having the above-mentioned configuration is manufactured.

Next, in order to verify actions and effects to be yielded by the present embodiment, there were fabricated, one piece each, various samples which differed in the width X of the electrode base metal surface 28*a* (hereinafter, referred to merely as the electrode base metal width X) and in the projecting dimension Y of the noble metal tip 32 (hereinafter, referred to merely as the tip projecting dimension Y). The samples were subjected to a desktop spark discharge test and evaluated in various ways. The test results are described below.

The samples were classified into Groups A to H according to an electrode base metal width X of 0 mm, 0.1 mm, 0.2 mm, 0.3 mm, 0.4 mm, 0.5 mm, 0.6 mm, and 0.7 mm. In each of Groups B to H, the samples having a tip projecting dimension Y of −0.1 mm (the discharge surface 32*a* of the noble metal tip 32 is recessed from the electrode base metal surface 28*a* of the protrusion 28), 0 mm, 0.1 mm, 0.2 mm, 0.3 mm, and 0.4 mm are named Samples 1 to 6, respectively.

Two kinds of desktop spark discharge tests; namely, a sparking performance test and a sparking position test, were conducted.

The sparking performance test was conducted as follows: the samples were mounted in chambers which contained the atmosphere at a pressure of 0.4 MPa; the air flowed through the spark discharge gap 35 at a velocity of 5.0 m/sec; and each of the samples generated 100 spark discharges. The samples were checked for the number of occurrences of spark blowout (intermittence of discharge) from video images and measured discharge waveforms, whereby the incidence of spark blowout was verified. Table 1 shows the evaluation results of the test.

TABLE 1

| | | Electrode base metal width X | | | | | | | |
|---|---|---|---|---|---|---|---|---|---|
| | | A<br>0 mm | B<br>0.1 mm | C<br>0.2 mm | D<br>0.3 mm | E<br>0.4 mm | F<br>0.5 mm | G<br>0.6 mm | H<br>0.7 mm |
| TTip projecting ddimension Y | 1<br>−0.1 mm | FFF<br>28% | AAA<br>8% | AAA<br>6% | AAA<br>3% | AAA<br>2% | AAA<br>0% | AAA<br>0% | AAA<br>0% |
| | 2<br>0 mm | | AAA<br>9% | AAA<br>5% | AAA<br>4% | AAA<br>4% | AAA<br>2% | AAA<br>2% | AAA<br>3% |
| | 3<br>0.1 mm | | AAA<br>7% | AAA<br>5% | AAA<br>3% | AAA<br>3% | AAA<br>0% | AAA<br>0% | AAA<br>0% |

TABLE 1-continued

| | Electrode base metal width X | | | | | | | |
|---|---|---|---|---|---|---|---|---|
| | A 0 mm | B 0.1 mm | C 0.2 mm | D 0.3 mm | E 0.4 mm | F 0.5 mm | G 0.6 mm | H 0.7 mm |
| 4 0.2 mm | | AAA 5% | AAA 4% | AAA 3% | AAA 1% | AAA 0% | AAA 0% | AAA 1% |
| 5 0.3 mm | | BBB 15% | BBB 15% | BBB 15% | BBB 14% | BBB 11% | BBB 12% | BBB 12% |
| 6 0.4 mm | | BBB 19% | BBB 18% | BBB 18% | BBB 15% | BBB 14% | BBB 14% | BBB 14% |

In Table 1, samples having an incidence of spark blowout of less than 10% are evaluated as "AAA," indicating that the samples exhibit excellent sparking performance; samples having an incidence of spark blowout of 10% to less than 20% are evaluated as "BBB," indicating that the samples exhibit good sparking performance; and samples having an incidence of spark blowout of 20% or greater are evaluated as "FFF," indicating that the samples exhibit poor sparking performance. However, evaluation appearing in Table 1 indicates relative evaluation in the present test and does not necessarily mean that the samples judged failure (FFF) cannot be used as products.

As is understood from Table 1, Group A, in which the electrode base metal width X is 0 mm, shows an incidence of spark blowout of 28%, which is extremely high as compared with those of Groups B to H. Regarding Group A (see FIG. 7), in which the electrode base metal with X is 0 mm; i.e., the electrode base metal surface 28*a* (discharge allowance surface) is absent around the noble metal tip 32, since the tip projecting dimension Y is not involved, only the sample having a thickness of the noble metal tip 32 of 0.3 mm (corresponding to samples having a tip projecting dimension Y of 0.3 mm) was subjected to the sparking performance test.

As for Groups B to H, as is understood from comparison of Samples 1 to 4 with Samples 5 and 6, Samples 5 and 6, which have a tip projecting dimension Y of 0.3 mm or greater, show a high incidence of spark blowout. Conceivably, this is because the spark discharge gap 35 between the center electrode 5 and the electrode base metal surface 28*a* of the protrusion 28 becomes relatively long.

In view of the test results mentioned above, an electrode base metal width X of 0.1 mm or greater is preferred, and a tip projecting dimension Y of 0.2 mm or less is preferred. Further, almost no difference is observed in incidence of spark blowout between Samples 1 to 6 of Groups G and H, which have an electrode base metal width X of 0.6 mm or greater, and Samples 1 to 6 of Group F. Therefore, in view of deterioration in ignition performance and workability, preferably, the upper limit of the electrode base metal width X is set to 0.5 mm or less.

In the sparking position test, the samples were mounted in chambers which contained the atmosphere at a pressure of 0.4 MPa, and each of the samples generated 100 spark discharges while air flow was absent. The samples were checked for a sparking position on the ground electrode 27 from video images, and the percentage of sparking to the discharge surface 32*a* of the noble metal tip 32 was examined. The test results are shown in Tables 2, 3, and 4. For the sake of convenience, Tables 2, 3, and 4 show the test results of only Samples 1 to 4 of Groups B, D, F, and H.

TABLE 2

| | | Electrode base metal width X | | | |
|---|---|---|---|---|---|
| | | B 0.1 mm | D 0.3 mm | F 0.5 mm | H 0.7 mm |
| Tip projecting dimension Y | 1 −0.1 mm | 3% | 5% | 10% | 12% |
| | 2 0 mm | 78% | 89% | 95% | 98% |
| | 3 0.1 mm | 92% | 98% | 100% | 100% |
| | 4 0.2 mm | 100% | 100% | 100% | 100% |

Figure 5:
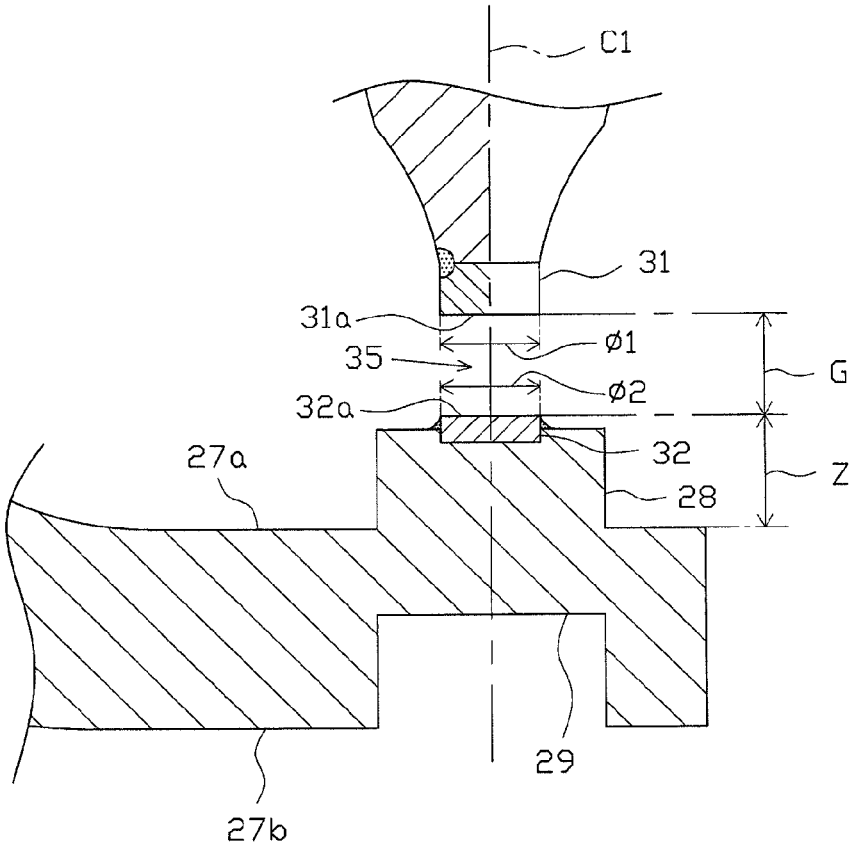
[FIG. 5] Enlarged partially cutaway view showing an essential portion of the center electrode and that of the ground electrode.

Table 2 shows the test results of the samples having a diameter ϕ1 (see FIG. 5) of the noble metal tip 31 of the center electrode 5 of 0.8 mm and a diameter ϕ2 (see FIG. 5) of the noble metal tip 32 of the ground electrode 27 of 0.8 mm.

TABLE 3

| | | Electrode base metal width X | | | |
|---|---|---|---|---|---|
| | | B 0.1 mm | D 0.3 mm | F 0.5 mm | H 0.7 mm |
| Tip projecting dimension Y | 1 −0.1 mm | 3% | 3% | 5% | 6% |
| | 2 0 mm | 15% | 17% | 21% | 23% |
| | 3 0.1 mm | 18% | 22% | 26% | 27% |
| | 4 0.2 mm | 32% | 39% | 45% | 47% |

Table 3 shows the test results of the samples having a diameter ϕ1 of the noble metal tip 31 of the center electrode of 0.8 mm and a diameter ϕ2 of the noble metal tip 32 of the ground electrode 27 of 0.7 mm.

TABLE 4

| | | Electrode base metal width X | | | |
|---|---|---|---|---|---|
| | | B 0.1 mm | D 0.3 mm | F 0.5 mm | H 0.7 mm |
| Tip projecting dimension Y | 1 −0.1 mm | 4% | 7% | 10% | 14% |
| | 2 0 mm | 85% | 92% | 97% | 100% |
| | 3 0.1 mm | 92% | 98% | 100% | 100% |
| | 4 0.2 mm | 100% | 100% | 100% | 100% |

Table 4 shows the test results of the samples having a diameter ϕ1 of the noble metal tip 31 of the center electrode 5 of 0.8 mm and a diameter ϕ2 of the noble metal tip 32 of the ground electrode 27 of 0.9 mm.

As is understood from Table 2, Samples 1 having a tip projecting dimension Y of −0.1 mm of Groups B, D, F, and H show extremely low percentages of sparking to the discharge surface 32*a* of the noble metal tip 32 as compared with Samples 2 to 4 of the groups. That is, the percentage of sparking to the electrode base metal surface 28*a* of the protrusion 28 is high. Conceivably, this is for the following reason: when the discharge surface 32*a* of the noble metal tip 32 is recessed from the electrode base metal surface 28*a* of the protrusion 28, even in a condition free from the influence of swirls or the like, since the distance between the center electrode 5 (noble metal tip 31) and the electrode base metal surface 28*a* around the noble metal tip 32 is smaller than the distance between the center electrode 5 (noble metal tip 31) and the discharge surface 32*a* of the noble metal tip 32, sparking to the electrode base metal surface 28*a* of the protrusion 28 is apt to occur.

Therefore, in view of the fact that an Ni alloy serving as the electrode base metal of the ground electrode 27 is lower in durability than the noble metal tip 32, preferably, the tip projecting dimension Y is set to 0 mm or greater for enhancement of durability.

As is understood from comparison of test results of Table 2 with those of Table 3, in the case where the diameter ϕ2 of the noble metal tip 32 of the ground electrode 27 is smaller than the diameter ϕ1 of the noble metal tip 31 of the center electrode 5, the samples of Groups B, D, F, and H show extremely low percentages of sparking to the discharge surface 32*a* of the noble metal tip 32. That is, the percentage of sparking to the electrode base metal surface 28*a* of the protrusion 28 is high. Conceivably, this is because, as viewed from the direction of the axis C1, there is an overlapping area between the discharge surface 31*a* (see FIG. 5) of the noble metal tip 31 of the center electrode 5 and the electrode base metal surface 28*a* of the protrusion 28.

Meanwhile, as is understood from comparison of test results of Table 2 with those of Table 4, in the case where the diameter ϕ2 of the noble metal tip 32 of the ground electrode 27 is larger than the diameter ϕ1 of the noble metal tip 31 of the center electrode 5, similar to the case where the diameters ϕ1 and ϕ2 of the noble metal tips 31 and 32 are equal to each other, the samples of Groups B, D, F, and H show high percentages of sparking to the discharge surface 32*a* of the noble metal tip 32. Also, almost no difference is observed in incidence of spark blowout between the case where the diameter ϕ2 of the noble metal tip 32 of the ground electrode 27 is larger than the diameter ϕ1 of the noble metal tip 31 of the center electrode 5 and the case where the diameters ϕ1 and ϕ2 of the noble metal tips 31 and 32 are equal to each other.

Figure 6:
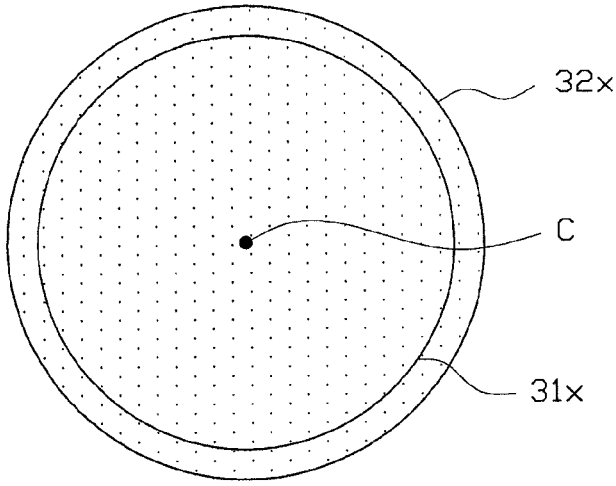
[FIG. 6] Schematic view showing a projected image of a noble metal tip of the center electrode and a projected image of a noble metal tip of the ground electrode as projected on a plane orthogonal to the direction of the axis.

From the test results mentioned above, preferably, when, as shown in FIG. 6, the discharge surface 31*a* of the noble metal tip 31 of the center electrode 5 and the discharge surface 32*a* of the noble metal tip 32 of the ground electrode 27 are projected onto a plane orthogonal to the direction of the axis C1, a projected image 31*x* of the discharge surface 31*a* of the noble metal tip 31 of the center electrode 5 does not protrude from a projected image 32*x* of the discharge surface 32*a* of the noble metal tip 32 of the ground electrode 27.

Figure 7:
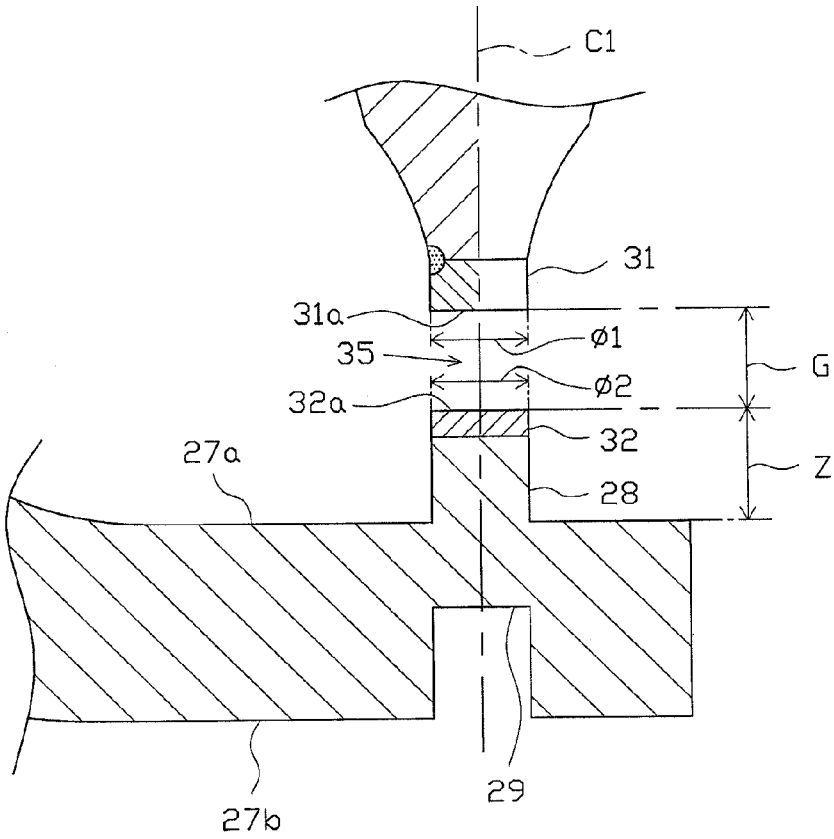
[FIG. 7] Enlarged partially cutaway view showing an essential portion of a center electrode and an essential portion of a ground electrode in a conventional spark plug.

Next, in order to verify actions and effects yielded by the present embodiment, fabricated as comparative examples were spark plug samples in which the electrode base metal surface 28*a* (discharge allowance surface) was absent around the noble metal tip 32 as shown in FIG. 7. Specifically, there were fabricated, one piece each, various samples which differed in the distance along the direction of the axis C1 between the inside surface 27*a* of the ground electrode 27 and the discharge surface 32*a* of the noble metal tip 32; i.e., a projecting dimension Z of the noble metal tip 32 (hereinafter, referred to merely as the tip projecting dimension Z), and in a dimension G of the spark discharge gap 35 (hereinafter, referred to merely as the gap dimension G). The samples were subjected to a sparking performance test under the same conditions as those of the aforementioned sparking performance test and tested for incidence of spark blowout. Table 5 shows the evaluation results of the test.

The samples were classified into Groups J to M according to a gap dimension G of 0.6 mm, 0.7 mm, 0.8 mm, 0.9 mm, and 1.1 mm. In each of Groups A to N, the samples having a tip projecting dimension Z of 0.3 mm, 0.4 mm, 0.5 mm, 0.6 mm, and 0.8 mm are named Samples 1 to 5, respectively. The samples have a diameter ϕ1 of the noble metal tip 31 of the center electrode 5 of 0.8 mm and a diameter ϕ2 of the noble metal tip 32 of the ground electrode 27 of 0.8 mm.

TABLE 5

| | | Gap dimension G | | | | |
|---|---|---|---|---|---|---|
| | | J 0.6 mm | K 0.7 mm | L 0.8 mm | M 0.9 mm | N 1.1 mm |
| Tip projecting dimension Z | 1 0.3 mm | BBB 0% | BBB 0% | BBB 9% | BBB 12% | BBB 15% |
| | 2 0.4 mm | BBB 2% | BBB 4% | BBB 12% | BBB 14% | BBB 17% |
| | 3 0.5 mm | BBB 5% | BBB 8% | FFF 20% | FFF 21% | FFF 28% |
| | 4 0.6 mm | BBB 7% | BBB 9% | FFF 20% | FFF 24% | FFF 29% |
| | 5 0.8 mm | BBB 7% | BBB 10% | FFF 22% | FFF 28% | FFF 36% |

In Table 5, samples having an incidence of spark blowout of less than 20% are evaluated as "BBB," indicating that the samples exhibit good sparking performance; and samples having an incidence of spark blowout of 20% or greater are evaluated as "FFF," indicating that the samples exhibit poor sparking performance. However, evaluation appearing in Table 5 indicates relative evaluation in the present test and does not necessarily mean that the samples judged failure (FFF) cannot be used as products.

As is understood from Table 5, regarding Groups J and K, in which the gap dimension G is 0.6 mm or 0.7 mm, all of Samples 1 to 5, which differ in the tip projecting dimension Z, show an incidence of spark blowout of less than 20%, which is lower than incidences of spark blowout of the samples of Groups L, M, and N. This indicates that spark blowout or the like is inherently unlikely to occur in the case of a configuration in which the gap dimension G is less than 0.8 mm.

As for Groups L, M, and N, as is understood from comparison of Samples 1 and 2 with Samples 3 to 5, Samples 1 and 2 show an incidence of spark blowout of less than 20%, indicating that Samples 1 and 2 are low in incidence of spark blowout as compared with Samples 3 to 5, which have a tip projecting dimension Z of 0.5 mm or greater. That is, spark blowout or the like is inherently unlikely to occur with respect to a configuration in which the tip projecting dimension Z is less than 0.5 mm.

In view of the test results mentioned above, conceivably, a spark plug having a gap dimension G of 0.8 mm or greater and a tip projecting dimension Z of 0.5 mm or greater is likely to encounter the occurrence of spark blowout or the like. Therefore, the above-mentioned actions and effects of the present embodiment are further yielded in application of the present invention to such a spark plug.

The present invention is not limited to the above-described embodiment, but may be embodied, for example, as follows.

(a) In the embodiment described above, the width X of the electrode base metal surface 28*a* of the protrusion 28 is 0.1 mm to 0.5 mm inclusive. However, the present invention is not limited thereto, but may be embodied at least such that the cross-sectional area of the noble metal tip 32 is smaller than the area of the distal end surface of the protrusion 28, so that, as viewed on the distal end surface of the protrusion 28, the electrode base metal surface 28*a* is present around the noble metal tip 32. However, as is understood from the test results mentioned above, a width X of the electrode base metal surface 28*a* of 0.1 mm to 0.5 mm inclusive is more preferred.

(b) In the embodiment described above, the projecting dimension Y of the noble metal tip 32 is 0 mm to 0.2 mm inclusive. However, the projecting dimension Y is not limited thereto. However, as is understood from the verification results mentioned above, a projecting dimension Y of 0 mm to 0.2 mm is more preferred.

(c) In the embodiment described above, the noble metal tips 31 and 32 are formed of an iridium alloy or a platinum alloy. However, the present invention is not limited thereto. The noble metal tips 31 and 32 may be formed of a noble metal alloy which contains another noble metal as a main component. Also, the noble metal tip 31 of the center electrode 5 may be eliminated. However, in view of enhancement of durability, preferably, the center electrode 5 has the noble metal tip 31.

(d) In the embodiment described above, the noble metal tip 32 is laser-welded to the ground electrode 27. However, the present invention is not limited thereto. Resistance welding or other methods may be employed. In the case of employment of resistance welding, the fusion portion 33 is not formed; therefore, the electrode base metal surface 28*a* accounts for the most part of the distal end surface of the protrusion 28 excluding the noble metal tip 32.

Figure 8:
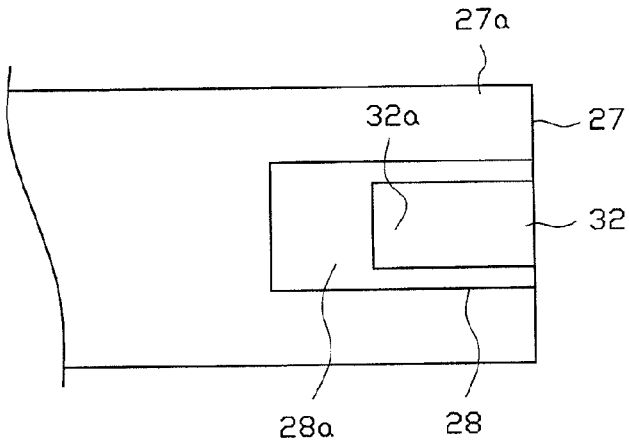
[FIG. 8] Schematic view of a protrusion of a ground electrode in another embodiment of the present invention as viewed from a center electrode in the direction of an axis.
Figure 9:
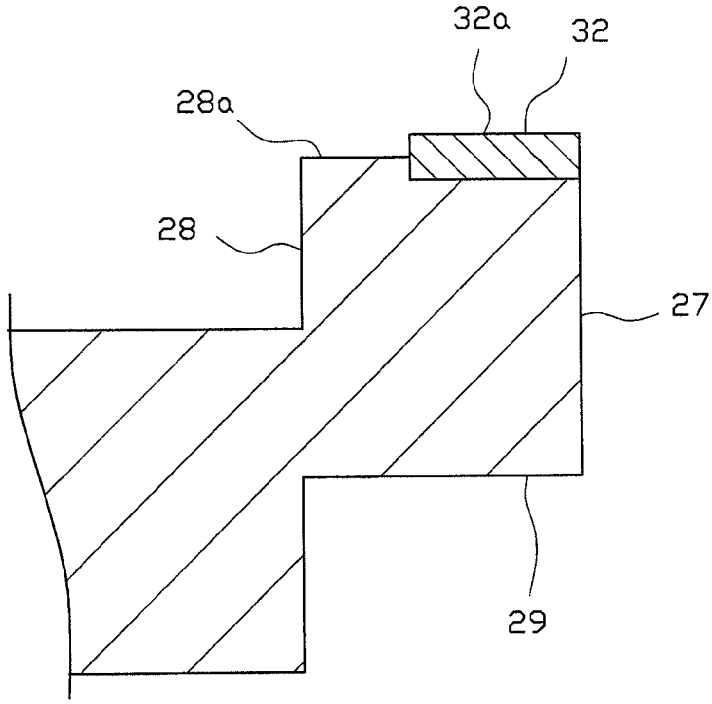
[FIG. 9] Schematic sectional view showing a protrusion and its vicinity of a ground electrode in a still another embodiment of the present invention.

(e) The shape of the protrusion 28 and that of the noble metal tip 32 are not limited to a circular shape of the embodiment described above (a protrusion having a circular columnar shape and a tip having a circular cross section). The protrusion 28 and the noble metal tip 32 may have a shape other than a circular shape; for example, a polygonal shape (a protrusion having a prismatic columnar shape and a tip having a polygonal cross section). For example, as shown in FIGS. 8 and 9, the following configuration may be employed: the protrusion 28 having a quadrangular prismatic columnar shape is formed at a distal end portion of the ground electrode 27 in such a manner as to project in the direction of the axis C1 (in the vertical direction in FIG. 9) along the distal end surface of the ground electrode 27, and the noble metal tip 32 having a quadrangular (rectangular) cross section taken along a direction orthogonal to the direction of the axis C1 (along the left-right direction in FIGS. 8 and 9) is disposed on the distal end surface (on the top surface in FIG. 9) of the protrusion 28 in such a manner as to be flush with the distal end surface of the ground electrode 27.

(f) In the embodiment described above, the electrode base metal surface 28*a* is formed around the entire periphery of the noble metal tip 32. However, the present invention is not limited thereto. As shown in FIGS. 8 and 9, the electrode base metal surface 28*a* is formed around at least a portion of the periphery of the noble metal tip 32. However, forming the electrode base metal surface 28*a* around the entire periphery of the noble metal tip 32 is more preferred since, even when sparks drift in any direction by the influence of swirls or the like, discharge is reliably maintained.

Figure 10:
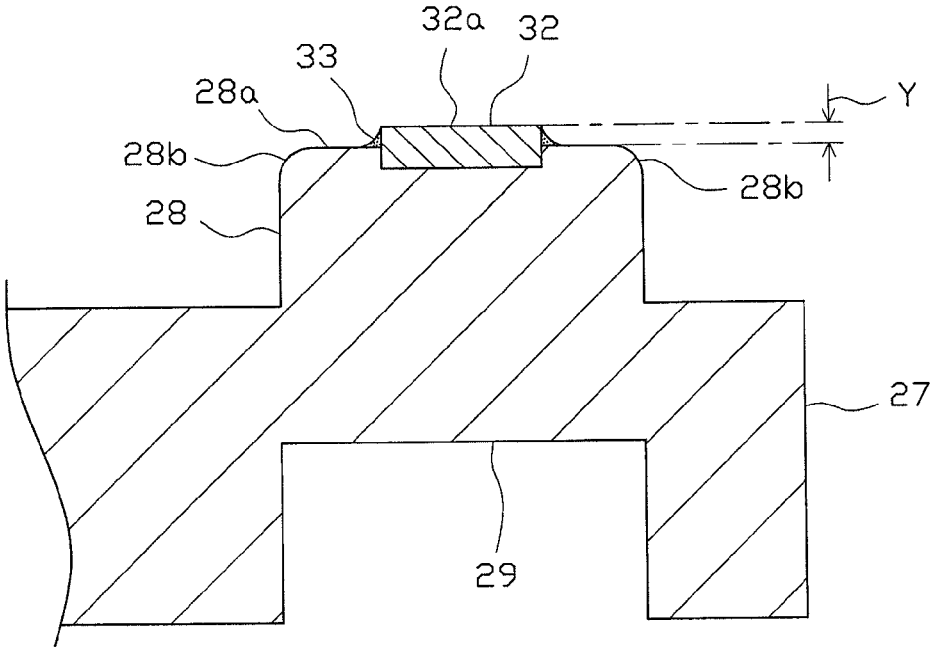
[FIG. 10] Schematic sectional view showing a protrusion and its vicinity of a ground electrode in a further embodiment of the present invention.

(g) In the embodiment described above, the electrode base metal surface 28*a* has an angular portion at its edge. However, as shown in FIG. 10, chamfering may be performed on the edge of the electrode base metal surface 28*a* so as to form a chamfer portion 28*b* at the edge. FIG. 10 shows a rounded chamfer portion having a curved shape as the chamfer portion 28*b*. However, the chamfer portion 28*b* is not limited thereto. A flat chamfer portion having a taper shape may be employed as the chamfer portion 28*b*.

Meanwhile, a comparative test was conducted on aforementioned Samples 1 to 6, which differed in tip projecting dimension Y, of aforementioned Groups A to H, which differed in electrode base metal width X, for comparing the incidence of spark blowout when the chamfer portion 28*b* is provided at the edge of the electrode base metal surface 28*a*, and the incidence of spark blowout when the chamfer portion 28*b* is not provided. The samples were subjected to a sparking performance test under the same conditions as those of the sparking performance test of the embodiment described above. Table 6 shows the test results.

TABLE 6

| | Tip | Electrode base metal width X | | | | |
|---|---|---|---|---|---|---|
| Chamfer portion | projecting dimension Y | B 0.1 mm | D 0.3 mm | F 0.5 mm | G 0.6 mm | H 0.7 mm |
| Present | 4 | AAA | AAA | AAA | AAA | AAA |
| | 0.2 mm | 1% | 0% | 0% | 0% | 0% |
| | 5 | AAA | AAA | AAA | AAA | AAA |
| | 0.3 mm | 7% | 5% | 3% | 0% | 0% |
| | 6 | AAA | AAA | AAA | AAA | AAA |
| | 0.4 mm | 10% | 8% | 7% | 4% | 2% |
| Absent | 4 | AAA | AAA | AAA | AAA | AAA |
| | 0.2 mm | 5% | 3% | 0% | 0% | 1% |
| | 5 | BBB | BBB | BBB | BBB | BBB |
| | 0.3 mm | 15% | 15% | 11% | 12% | 12% |
| | 6 | BBB | BBB | BBB | BBB | BBB |
| | 0.4 mm | 19% | 18% | 14% | 14% | 14% |

In Table 6, samples having an incidence of spark blowout of less than 10% are evaluated as "AAA," indicating that the samples exhibit excellent sparking performance, and samples having an incidence of spark blowout of 10% to less than 20% are evaluated as "BBB," indicating that the samples exhibit good sparking performance. For the sake of convenience, Table 6 shows the test results of only Samples 4 to 6 of Groups B, D, F, G, and H.

As is understood from Table 6, the samples having the chamfer portion 28*b* at the edge of the electrode base metal surface 28*a* can reduce the incidence of spark blowout as compared with the samples in which the chamfer portion 28*b* is not provided. Conceivably, this is because the formation of the chamfer portion 28*a* relatively increases the area of the discharge allowance surface, to which sparking is enabled.

Description of Reference Numerals

1: spark plug; 2: ceramic insulator; 3: metallic shell; 5: center electrode; 27: ground electrode; 28: protrusion; 28*a*: electrode base metal surface; 29: hole portion; 31, 32: noble metal tip; 33: fusion portion; 35: spark discharge gap; C1: axis; X: electrode base metal width; and Y: tip projecting dimension

The invention claimed is:

1. A spark plug comprising a center electrode extending in a direction of an axis, an insulator which holds the center electrode, a metallic shell which holds the insulator, a ground electrode whose proximal end portion is joined to a front end portion of the metallic shell and which is bent and fixed such that an inside surface of a distal end portion thereof faces a front end portion of the center electrode, and a noble metal tip joined to the inside surface of the ground electrode, a spark discharge gap being formed between the center electrode and the noble metal tip of the ground electrode, the spark plug being characterized in that:

the inside surface of the ground electrode has a columnar protrusion projecting in the direction of the axis and formed of an electrode base metal of the ground electrode which contains nickel as a main component;

the noble metal tip whose cross-sectional area is smaller than an area of a distal end surface of the protrusion is joined to the distal end surface of the protrusion, and a discharge allowance surface is a part of the distal end surface of the protrusion and is formed around at least a portion of a periphery of the noble metal tip, the discharge allowance surface is formed of the electrode base metal of the ground electrode;

a dimension of the spark discharge gap, which is a distance between a discharge surface of the center electrode and a discharge surface of the noble metal tip of the ground electrode as measured along the direction of the axis, is 0.8 mm or greater;

a projecting dimension of the noble metal tip of the ground electrode, which is a distance between the inside surface of the ground electrode and the discharge surface of the noble metal tip of the ground electrode as measured along the direction of the axis, is 0.5 mm or greater; and when the discharge surface of the center electrode and the discharge surface of the noble metal tip of the ground electrode are projected onto a plane orthogonal to the direction of the axis, a projected image of the discharge surface of the center electrode does not protrude from a projected image of the discharge surface of the noble metal tip of the ground electrode.

2. A spark plug according to claim 1, wherein the discharge allowance surface has a chamfer portion at an edge thereof.

3. A spark plug according to claim 1, wherein the discharge allowance surface is formed around the entire periphery of the noble metal tip.

4. A spark plug according to claim 1, wherein the protrusion and the noble metal tip are in such a relation that a minimum distance between an outer periphery of the protrusion and an outer periphery of the noble metal tip is 0.1 mm to 0.5 mm inclusive.

5. A spark plug according to claim 1, wherein the noble metal tip projects from the distal end surface of the protrusion such that a projecting dimension of the noble metal tip as measured from the distal end surface of the protrusion along the direction of the axis is 0 mm to 0.2 mm inclusive.

6. A spark plug according to claim 1, wherein the ground electrode has a hole portion formed at an outside surface opposite the inside surface of the ground electrode with respect to the direction of the axis at a position corresponding to the protrusion.

7. A method of manufacturing a spark plug comprising a center electrode extending in a direction of an axis, an insulator which holds the center electrode, a metallic shell which holds the insulator, a ground electrode whose proximal end portion is joined to a front end portion of the metallic shell and which is bent and fixed such that an inside surface of a distal end portion thereof faces a front end portion of the center electrode, a columnar protrusion provided at the inside surface of the ground electrode, and a noble metal tip joined to a distal end surface of the protrusion, a spark discharge gap being formed between the center electrode and the noble metal tip of the ground electrode and between the center electrode and the distal end surface of the protrusion, the method being characterized by comprising:

a welding step of welding the noble metal tip to an original body of the ground electrode having substantially the form of a straight bar;

a press working step of performing press working on the original body of the ground electrode at least in a region which encompasses the noble metal tip, from a side opposite a side from which the noble metal tip is welded, thereby forming the protrusion; and a bending step of bending the original body of the ground electrode in such a manner that the distal end surface of the protrusion including the noble metal tip faces the front end portion of the center electrode, thereby forming the spark discharge gap.

* * * * *